US006544020B1

(12) United States Patent
Bahnen et al.

(10) Patent No.: US 6,544,020 B1
(45) Date of Patent: Apr. 8, 2003

(54) COOLED SCREW VACUUM PUMP

(75) Inventors: Rudolf Bahnen, Roetgen (DE); Thomas Dreifert, Köln (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/529,329

(22) PCT Filed: Jun. 19, 1998

(86) PCT No.: PCT/EP98/03756

§ 371 (c)(1),
(2), (4) Date: Apr. 10, 2000

(87) PCT Pub. No.: WO99/19630

PCT Pub. Date: Apr. 22, 1999

(30) Foreign Application Priority Data

Oct. 10, 1997 (DE) ..... 197 45 616

(51) Int. Cl.[7] ..... F03C 2/00

(52) U.S. Cl. ..... 418/88; 418/91; 418/94; 418/9; 418/201.1

(58) Field of Search ..... 418/91, 94, 9, 418/201.1

(56) References Cited

U.S. PATENT DOCUMENTS

| | | | | |
|---|---|---|---|---|
| 2,938,664 A | | 5/1960 | Noller et al. | |
| 3,711,731 A | * | 1/1973 | Pluschke | 310/53 |
| 3,781,147 A | * | 12/1973 | Sato | 418/94 |
| 3,807,911 A | | 4/1974 | Caffrey | |
| 4,025,245 A | * | 5/1977 | Goloff | 418/94 |
| 4,073,607 A | | 2/1978 | Webb et al. | |
| 4,714,418 A | * | 12/1987 | Matsubara | 418/201.1 |
| 4,781,553 A | * | 11/1988 | Nomura et al. | 418/104 |
| 4,983,106 A | | 1/1991 | Wright et al. | |
| 5,836,746 A | * | 11/1998 | Marayama et al. | 418/201.1 |
| 5,904,473 A | * | 5/1999 | Dahmlos et al. | 418/70 |
| 5,924,855 A | * | 7/1999 | Dahmlos et al. | 418/201.1 |

FOREIGN PATENT DOCUMENTS

| | | | | |
|---|---|---|---|---|
| DE | 1290239 | | 3/1962 | |
| DE | 1428026 | | 12/1968 | |
| DE | 19522559 | A1 | 1/1997 | |
| DE | 19522560 | A1 | 1/1997 | |
| EP | 0 362757 | A2 | 4/1990 | |
| EP | 0362757 | A3 | 4/1990 | |
| EP | 0585911 | A1 | 3/1994 | |
| EP | 0697523 | A2 | 2/1996 | |
| EP | 0 697523 | A2 | 2/1996 | |
| EP | 0834018 | B1 | 4/1998 | |
| FR | 1290239 | | 3/1962 | |
| JP | 59-168290 | * | 9/1984 | 418/9 |
| JP | 61-279793 | * | 12/1986 | 418/94 |
| JP | 63-198789 | | 8/1988 | |
| JP | 3 111690 | | 5/1991 | |

OTHER PUBLICATIONS

Thermal Properties of Materials—Al Lab @ MIT–Sep. 6, 1994.*

* cited by examiner

*Primary Examiner*—Thomas Denion
*Assistant Examiner*—Theresa Trieu
(74) *Attorney, Agent, or Firm*—Fay, Sharpe, Fagan, Minnich & McKee, LLP

(57) ABSTRACT

A cooled screw vacuum pump has a housing (4) two rotating systems (5, 6) consisting each of a screw rotor (5) and a shaft (6), a floating device supporting the rotors having, on each shaft, two mutually spaced bearings (7, 8) and an empty space (31) arranged in each rotor (5) open on the bearing side, wherein is respectively located an element cooling the rotor internally. In order to improve cooling it is suggested that the bearing (7) of the support located on the rotor side, is placed outside the rotor (5) empty space (31), such that in said empty space (31) there is more room available for obtaining efficient cooling.

53 Claims, 2 Drawing Sheets

COOLED SCREW VACUUM PUMP

BACKGROUND OF THE INVENTION

The present invention relates to a cooled screw vacuum pump comprising two rotating systems, consisting each of a screw rotor and a shaft with a floating device supporting the rotors, having, on each shaft, two mutually spaced bearings and an empty space arranged in each rotor, open on the bearing side, wherein is located an element cooling the rotor internally.

In an already proposed screw vacuum pump of this type, the bearing of the floating support on the rotor side is located within a central hollow space, open toward the bearing side, inside the rotor. Cooling is effected with the aid of a lubricating oil, which is first passed, inside a central channel in the shaft, to the bearing on the side of the rotor. In known fashion, the transported oil volume is larger than is needed for lubrication of the bearing in order to be able to carry away the maximum amount of heat possible.

With respect to the screw vacuum pump, the oil volume which, according to the state of the art, can be passed through the empty space, is limited since it is not only the bearing but also the bearing support that must be accommodated in said empty space. Therefore, there is the risk of inadequate cooling on the pressure-side region of the screw vacuum pump since it is precisely in this region that the generated heat is greatest due to the executed compression work.

Because of the existing empty space inside the rotor, the wall thickness of the rotor is also limited in the bearing region of the empty space. As a result, it is only possible at very high temperature gradients, to carry off the heat developing in the pressure-side region of the screw threads via the suction side region of the rotor, the shaft and the cooling oil. High temperature or inadequate cooling of the pressure-side region of a screw vacuum pump results in uneven rotor expansions and thus in local clearance consumption between the rotors and between each of the rotors and the housing. Run-up of rotors may, in fact, be prevented by relatively large clearances.

Relatively large clearances, however, result in deterioration of the pump operating properties. Furthermore, with respect to the prior known screw vacuum pump, there exists the danger of overheating the bearing located in the empty space, all the more so since said bearing can only be lubricated with relatively warm oil. Finally, the prior known screw vacuum pump can only be operated with vertically arranged shafts.

The present invention is based on the object of equipping a screw vacuum pump of the initially mentioned kind with improved cooling means.

According to the invention, this object is solved by making use of the fact that the bearing on the rotor side of the support is located outside the empty space in the rotor. The invention facilitates effective cooling of the rotor from the inside without being impeded by the bearing and bearing support, so that the unwelcome clearance consumption will no longer occur in this critical region.

Each rotor appropriately consists of two segments with different thread profiles, whereby the thread depth of the pressure-side segment is smaller than the thread depth of the suction side segment. A lesser thread depth in the pressure-side segment provides more space for accommodation of the empty space needed for the internal cooling.

If, in addition, the rotor and housing are stepped in such manner that the pressure-side rotor segment has a smaller diameter than the suction-side rotor segment, then this measure creates more space in the housing for the accommodation of jacket cooling.

According to another characteristic of the invention, it is appropriate to additionally provide in the wall of the pump housing, i.e at least at rotor level, channels perfused by a cooling agent.

A cooling agent of this type permits, specifically in combination with the interior cooling of the rotor according to the invention, uniform tempering of the entire pump. Consequently, the pump is able to adopt variable temperatures with variable loads, without resulting in gap reductions. It is appropriate to also include in such tempering the bearings, the bearing supports and the driving motor, in order to prevent problems due to variable temperature expansions. Lastly, a jacket cooling of the proposed type has the benefit of having the effect of excellent sound deadening.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
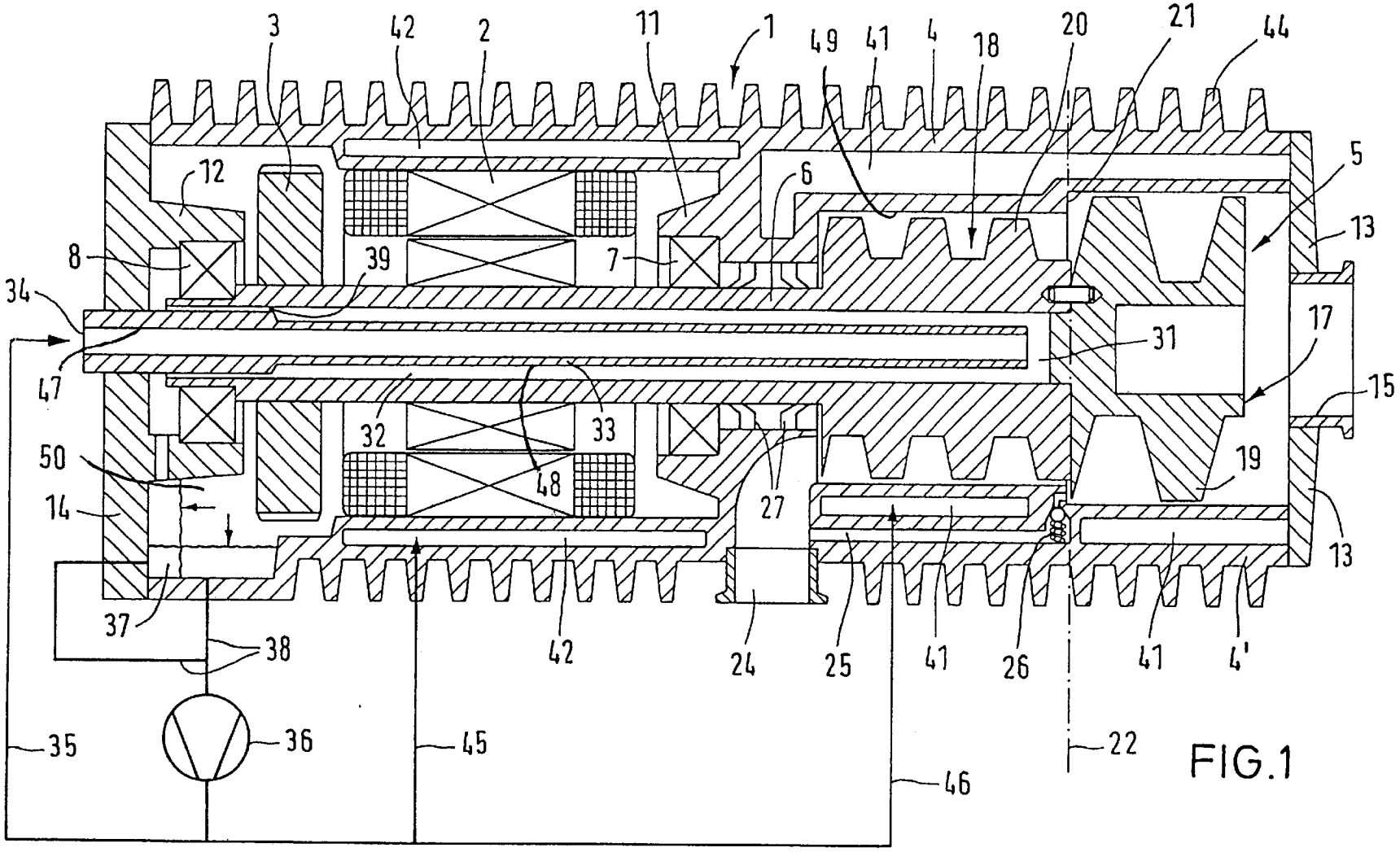
FIG. 1 is a section through a screw vacuum pump with cooling according to the invention.

With reference to FIG. 1, a section through an exemplary embodiment of a screw vacuum pump 1 according to the invention is depicted, i.e. at the level of that of the two rotating system which is equipped with a driving motor 2. Synchronization of the two rotating systems is effected with the aid of toothed wheels 3.

The rotating systems, which are arranged in housing 4, each comprise a rotor 5 and a shaft 6. Each rotor 5 is overhung, in other words, unilaterally supported. The shaft 6 supports itself in a housing 4 via bearings 7 and 8 and also bearing supports 11 and 12. Frontally, housing lids 13 and 14 are provided, with lid 13 on the rotor side being equipped with an inlet stub 15. Bearing support 12 is a component of the gear-side lid 14.

The rotor 5 consists of two positively joined rotor segments 17 and 18 having different profiles 19 and 20. The suction-side rotor segment 17 has a large volume profile 19 in order to achieve high volume flows in a helical compression chamber. The pressure-side segment 18 of rotor 5 has both a reduced profile volume as well as a lesser diameter. This reduces the cross section of the helical compression chambers or pumping chambers 49. Internal compression is obtained, and the work done on compression is reduced.

The inner wall of housing 4 is adapted to the rotor gradation (Gradation 21). A dotted line 22 indicates that the housing may be designed divisible at the level of gradation 21. As a result, it is possible to replace the suction-side rotor segment 17 and the suction side element 4' of housing 4 with rotor segments having different profiles, lengths and/or diameters as well as having housing segments 4' adapted to same, in order to be able to adapt the pump to different applications.

The outlet of pump 1 which is adjacent to the pressure-side end of the thread turns is identified by the numeral 24. It is laterally conducted outward. A housing bore 25 also issues into the outlet, joining the compression chamber with the outlet at the level at which its cross-section decreases-either by gradation or by change in the thread profile. In the housing bore 25, there is a non-return valve 26 which opens with excessive pressure in the compression chamber and short-circuits the suction-side thread turns of the rotor segment 17 with the outlet 24. In order to seal the helical compression chambers from the support, shaft gaskets 27 are provided which are located between bearing 7 and the rotor segment 18.

The cooling system in the depicted exemplary embodiment comprises a rotor with interior cooling arrangement and a housing jacket to facilitate cooling.

For realization of the rotor interior cooling, the rotor 5 is equipped with a hollow space 31, open toward its bearing-side. Said hollow space may extend through almost the entire rotor 5.

With respect to rotor 5, consisting of two segments 17 and 18, the delivery or pressure-side segment 18 is appropriately designed hollow. The suction-side segment 17 closes the suction-side end of the hollow space 31. The shaft 6, which is appropriately designed in one single piece with rotor 5 or with the pressure-side segment 18 of rotor 5, is likewise hollow (hollow space 32). In the hollow spaces 31, 32 there is a central cooling pipe 33, which is conducted, on the side of the bearing, out of the shaft 6 and ends, on the side of the rotor, shortly before the suction-side end of hollow space 31. The cooling pipe 33 and the annular space formed by the cooling pipe 33 and the hollow shaft 6 are available for the supply or removal of a coolant.

In the represented exemplary embodiment of the present invention, the bearingside opening 34 of the cooling pipe 33 is in communication via line 35 with the outlet of a cooling agent pump 36. In addition, in the region of housing lid 14 there is a coolant sump 37 in a coolant chamber 50. Coolant sump 37 is connected via line system 38 with the inlet of cooling agent pump 36. The sump 37 and the line system 38 are designed in such manner that the represented pump 1 can be operated in any position ranging from vertical to horizontal. Cooling agent levels which occur with horizontal and with vertical position of the pump 1 are indicated. Depending upon whether the cooling agent pump 36 is located outside (as depicted) or inside (for example on the second, not visible shaft of pump 1 at the level of the driving motor 2) of housing 4, the opening 34 of the cooling pipe 33 is located either outside or inside of housing 4.

For operation of the internal cooling of rotor 5, the cooling agent is transported by the cooling agent pump 36 from the cooling agent sump 37 via the cooling pipe's inner surface or first channel 47 into the empty space 31 in rotor 5. From there, it flows back into sump 37 via the annular space or second channel 48 between cooling pipe 33 and shaft 6. The hollow space 31 is located at the level of the pressure-side region of the thread turns of pump 1, so that this region in particular is cooled effectively. The cooling agent flowing back outside of the cooling pipe 33 along the second channel 48 tempers, among others, the hollow shaft 6, the bearings 7 and 8, the driving motor 2 (on the armature side), and the toothed wheels 3, so that the thermal expansion problems are reduced.

It is advisable for the cross section of the second channel 48 between the cooling pipe 33 and the shaft 6 to decrease at the pressure end; this can be done, for example, by providing the cooling pipe 33 with a larger outside diameter in this area, As a result, a constructed pass-through opening or narrowed region 39 is formed. This constriction ensures that the spaces holding the coolant are completely filled.

It is advisable to select a material with poor thermal conductivity (such as plastic/special steel, etc.) for the cooling pipe 33. As a result, the rotor 5 will be cooled more effectively, and the components of the pump 1 near the shaft will be tempered more uniformly.

The housing cooling system shown comprises cavities or a first and a second set of channels 41, 42, respectively, in the housing 4. The first set of cooling channels provided in the area of the rotor 5 are designated 41; the second set of cooling channels in the area of the motor 2 are designated 42.

One of the jobs of the cooling channels 41 in the area of the rotor 5 is to carry away the heat which develops especially on the pressure side of the rotor 5. Another job of the channels is to temper the housing 4 as uniformly as possible in the entire area of the rotor. Finally, the channels are designed to give up the absorbed heat to the outside. The channels 41 through which the coolant flows therefore extend along the entire length of the rotor 5. The housing lid 13 serves to seal off the channels 41 on the suction side. The housing 4 is also cooled effectively on the pressure side.

Cooling channels 42, located at the level of the driving motor 2, have the mentioned objects as well. They produce tempering of the driving motors (on the side of the coils) as well as tempering of the bearing support 11. Finally, they increase, to a significant extent, the thermal discharge via the exterior surfaces of pump 1. The pump is appropriately equipped with fins 44, at least at the level of the cooling channels 41 and 42.

Feeding the cooling channels 41, 42 with cooling agent is likewise done with the aid of the cooling agent pump 36, namely via lines 45 and 46, if they are to be perfused parallel. Depending upon the thermal requirements, there also exists the possibility of subsequently providing same with cooling agent. One of the lines 45 or 46 could then be eliminated. The cooling agent gets from hollow spaces 41, 42 back into the sump 37 via bores which are not represented in detail.

With vertical arrangement of shaft 6, the cooling agent located in the sump cools the bearing support 12, protruding into the sump 37. With horizontal arrangement, it is appropriate to let the returning cooling agent flow back over the internal side of lid 14, in order to cool both the bearing seat 12 as well as improve thermal discharge toward the outside.

In the depicted exemplary embodiment of the present invention according to FIG. 1, housing 4 and rotor 5 are—as already mentioned—designed partable at the level of line 22. Consequently, there exists the possibility of replacing the suction-side segments of rotor 5 (segment 17) and housing 4 (segment 4'). Pump 1 can be adapted to various applications by installing rotor segments 17 with different profiles 19, different length, different pitch and/or different diameter, combined in each case with an adapted housing segment. Various large profiles can be selected on the suction side in order to obtain high suction capacities, various long profiles on the suction side in order to obtain low end pressures and/or various volume gradations in order to obtain, for example, higher fluid compatibility with lower gradation or with higher gradation, high suction capacity with relatively small power consumption. Finally, there exists the possibility of providing, at the level of a reduction in the diameter of rotor 5, a circumferential groove in order to achieve, in certain applications, a release of pressure in this region.

A cooling agent flowing through the screw vacuum pump 1 may be water, oil (mineral oil, PTFE-oil or similar) or another liquid. The utilization of oil is appropriate in order to also lubricate the bearings 7 and 8 and the toothed wheels 3. Separate supply of cooling agent and lubricating agent, as well as corresponding gaskets, can thereby be eliminated. The only need being a controlled supply of oil to the bearings 7 and 8.

The described solutions permit beneficial selection of raw material. For example, the rotors 5 and the housing 4 may consist of relatively inexpensive aluminum materials. The proposed cooling and, most importantly, the uniform cooling of pump 1 have the effect that, even with variable operating temperatures and relatively small gaps, play does not consume local clearance which will result in rotor to rotor contact and/or rotor to housing contact. Further gap reduction is possible if materials are employed for the internal, thermally more stressed components of pump 1 (rotors, bearings, bearing supports, toothed wheels) which have a lower thermal expansion coefficient than the material for housing 4, which is less thermally stressed.

A moderate equilization of the expansion of all components of pump 1 is obtained as a result thereof. An exemplary selection of such material is steel, for example nickel chromium (CrNi) steel, for the interior components and aluminum for the housing. Bronze, brass or nickel silver (China or German silver) may also serve as materials for the interior components.

Figure 2:
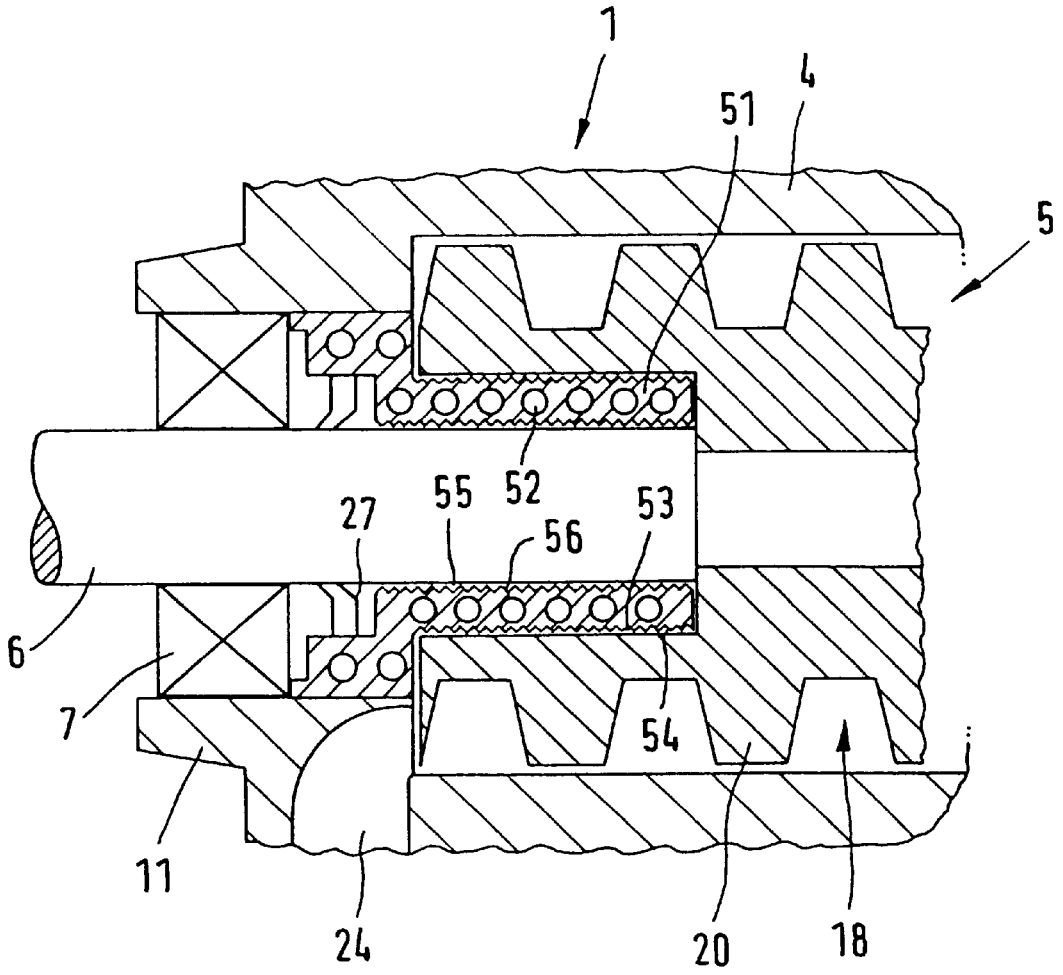
FIG. 2 is a partial section according to FIG. 1 with an additional design for cooling according to the invention.

In an exemplary embodiment of the present invention according to FIG. 2, the interior cooling of rotor 5 comprises a cooling bushing 51, which supports itself, on the bearing side on housing 4 and which projects into hollow space 31. The cooling bushing 51 surrounds the shaft 6, which is no longer designed hollow. It traverses the hollow space (31) and carries rotor 5 in the region of its suction-sided end. For supplying the cooling bushing 51 with cooling agent, one or several cooling channels 52 are provided, which are supplied by the cooling agent pump 36 in a manner not shown in more detail.

In order that the cooling bushing 51 will absorb as much heat as possible from rotor 5, a gap 53 between cooling bushing 51 and rotor 5 is selected as small as possible. In this region, the bushing 51 is equipped with threading 54, which has a pumping effect directed in the direction of the compression chamber. Dirt particles present there are held back.

A gap 55 between bushing 51 and shaft 6 is also relatively small in order to produce, with the aid of threading 56, a pumping effect on the interior side of bushing 51. Said pumping effect acts in the direction of gasket 27/bearing 7 and keeps oil particles out of the compression chamber.

Having thus described the preferred embodiment, the invention is now claimed to be:

1. A cooled screw vacuum pump, having a suction side and a pressure side, comprising a housing and two rotating systems, each system comprising a screw rotor, a shaft, mutually spaced bearings on each shaft supporting the rotors in a cantilever fashion, the bearings being disposed on the same side of the rotors, and a cavity defined in each rotor, open on the bearing side, within which cavity there is respectively located a cooling element which cools the rotor internally, the bearing closest to the rotor being located outside the cavity in the rotor.

2. The pump according to claim 1 wherein the cavity extends at least halfway through the entire rotor.

3. The pump according to claim 1 wherein the rotor is segmented and includes a suction-side segment and a pressure-side segment joined to the suction-side segment, the pressure-side segment being hollow and the suction-side segment having a projection received in the hollow of the pressure side segment, the cavity being defined in the hollow of the pressure side segment adjacent the suction-side segment and being open on the bearing side.

4. The pump according to claim 3 wherein the shaft is hollow and is connected with the rotor in fluid communication with the cavity.

5. The pump according to claim 4 wherein the hollow shaft and the pressure-side segment are integral.

6. The pump according to claim 4 further including a cooling pipe disposed in the hollow shaft with a discharge end at the cavity.

7. The pump according to claim 6 wherein the cooling pipe supplies a cooling agent to the cavity and further including an annular space defined between the hollow shaft and the cooling pipe for discharging the cooling agent from the cavity.

8. The pump according to claim 7 wherein a narrowed region is provided in the bearing-side end of the annular space between the hollow shaft and the cooling pipe.

9. The pump according to claim 7 wherein the cooling pipe is of a material having poor thermal conductivity.

10. The pump according to claim 1 wherein the cavity includes an annular space between the shaft and the rotor and further including:

a cooling bushing supported on the housing and which extends into the annular space.

11. The pump according to claim 10 wherein the cooling bushing includes a first set of channels through which a cooling agent flows.

12. Pump according to one of the preceding claims, characterized in that in the wall of the housing (4) of pump (1), i.e. at the level of the rotor (5), channels (41) are provided, through which flows a cooling agent.

13. The pump according to claim 12 further including: in a region of the housing encasing the bearings, a third set of channels through which the cooling agent flows.

14. The pump according to claim 13 wherein the shaft is hollow and is connected with the rotor in fluid communication with the cavity and further including:

a cooling pipe disposed in the hollow shaft with a discharge end at the cavity; and a cooling agent pump with an inlet in communication via a conductor system with a cooling agent sump located in the pump housing and with an outlet in communication with at least one of the cooling pipe, the first set of channels, the second set of channels, and the third set of channels.

15. The pump according to claim 14 wherein the sump and the conductor system are designed in such fashion that the inlet of the cooling agent pump is in communication with the sump, both in horizontal as well as in vertical positions of the pump.

16. The pump according to claim 10 wherein the cooling bushing includes external threading which performs a pumping action directed in the direction of a compression chamber.

17. The pump according to claim 10 wherein the cooling bushing includes internal threading which performs a pumping action directed in the direction of the adjacent bearing.

18. Pump according to one of the preceding claims, characterized in that the cooling agent flowing through the pump (1) is identical with the lubricating agent for the bearings (7, 8).

19. The pump according to claim 1 further including:

a first set of channels through a wall of the housing adjacent the rotors through which a cooling agent flows.

20. The pump according to claim 19 further including:

in a region of the housing encasing the bearings, a second set of channels through which the cooling agent flows.

21. The pump according to claim 20 wherein the shaft is hollow and is connected with the rotor in fluid communication with the rotor cavity and further including:

a cooling agent pump with an inlet in communication via a conductor system with a cooling agent sump located in the pump housing and with an outlet in communication with at least one of a cooling pipe disposed in the hollow shaft with a discharge end at the cavity, the first set of channels, and the second set of channels.

22. The pump according to claim 21 wherein the sump and the conductor system are designed in such fashion that the inlet of the cooling agent pump is in communication with the sump, both in horizontal and vertical positions of the pump.

23. The pump according to claim 1, wherein each rotor includes a suction-side segment and a pressure-side segment having a smaller diameter than the suction-side segment.

24. The pump according to claim 1, wherein the cooling element includes cooling fluid which contacts an inner surface of the cavity directly.

25. A cooled screw vacuum pump, having a suction side and a pressure side, comprising a housing that defines a pumping chamber and two rotating systems, each rotating system comprising:

a screw rotor, a shaft connected at one end to the screw rotor and extending out of the pumping chamber, at least two mutually spaced bearings on each shaft supporting the screw rotors in a cantilevered fashion in the pumping chamber, all bearings being on the same side of the rotor, and a cavity defined in each rotor, open on the bearing side, within which cavity there is respectively located a cooling fluid which cools the rotor internally, each rotor including a suction-side threaded segment and a pressure-side threaded segment with different thread profiles, the depth of the thread profile of the pressure-side segment being small than the depth of the thread profile of the suction-side segment.

26. The pump according to claim 2, wherein the pressure-side segment of the rotor has a smaller diameter than the suction-side segment.

27. A cooled screw vacuum pump having a suction side and a pressure side, the vacuum pump further including:

a housing and two rotating systems, each rotating system including a screw rotor, a shaft, and mutually spaced bearings on each shaft supporting the rotors;

each rotor defining a cavity open on a bearing side, within which cavity there is respectively:

a cooling element located in the cavity which cools the rotor internally;

a first helical pumping chamber defined in the housing;

a second helical pumping chamber with a reduced cross section relative to the first pumping chamber extending from the first pumping chamber to an outlet passage;

a bore extending from the outlet passage to an end of the first pumping chamber adjacent the second pumping chamber; and a non-return valve mounted to the bore to limit flow to a direction from the first pumping chamber to the outlet.

28. An evacuation apparatus comprising:

a housing having an inlet port and an outlet port;

a pump section arranged in said housing and having a suction side and an exhaust side, the pump section including interengaging rotors, each of the rotors having at least one threaded portion, the threaded portions, together with said housing, defining a gas-transporting space, each rotor further including a cooling cavity defined in and opening only to an exhaust-side portion of the rotor;

a means for circulating a cooling fluid flow through each cavity to cool the rotors internally;

a rotating shaft connected to the exhaust-side portion of each rotor;

bearings supporting the rotating shafts in a cantilever fashion, the bearings being axially spaced apart from the threaded portions, all on the same side of the rotor, and fliaidically isolated from the cooling fluid flow circulating through the cooling cavity; and at least one motor for rotating the interengaging rotors.

29. A cooled screw vacuum pump, having a suction side and a pressure side, the pump comprising a housing and two rotating systems, each rotating system comprising:

a rotor with a thread, the threads of the rotors and the inside of the housing acting together, when the rotors are rotating, to transport a gas from the suction side to the pressure side;

a hollow shaft supporting the rotor;

mutually spaced bearings on the shaft, all bearings being situated at the pressure side of the rotor;

each rotor being provided with a cavity open only to the pressure side, the bearing closest to the rotor being located outside the cavity, a cooling pipe extending axially through the hollow shaft forming a first channel in fluid connection with the cavity in the rotor; and, the cooling pipe and the hollow shaft forming a second channel surrounding the cooling pipe and in fluid connection with the cavity in the rotor.

30. The pump according to claim 29, wherein the first channel supplies a cooling agent to the cavity and the second channel discharges the cooling agent from the cavity.

31. The pump according to claim 30, further including a narrowed region is defined in a bearing-side end of the second channel.

32. The pump according to claim 31, wherein the cooling pipe is of a material having poor thermal conductivity.

33. The pump according to claim 29, wherein the cooling agent flowing through the pump is identical with a lubrication agent for the bearings.

34. The pump according to claim 29, wherein the rotor cavity extends at least halfway through the entire rotor.

35. A fluid cooled screw vacuum pump comprising:

a housing defining a pumping chamber and a coolant chamber which are fluidically isolated from each other, the housing defining a suction inlet into the pumping chamber and a pressure outlet from the pumping chamber; and a pair of rotating systems each including:

at least two bearings mounted to the housing in the coolant chamber;

a shaft rotatably mounted in the bearings with one end extending cantilevered into the pumping chamber;

a threaded screw rotor connected to the one end of the shaft, the screw rotor being supported only by the shaft in a cantilevered fashion in the pumping chamber, the screw rotors of the pair of rotating systems intermeshing to pump gas from the suction inlet to the pressure outlet; and a cavity defined in the shaft and the screw rotor in fluid communication with coolant chamber through which cavity coolant fluid is passed to cool the screw rotor internally.

36. A cooled screw vacuum pump, having a suction side and a pressure side, comprising a housing and two rotating systems, each rotating system comprising:

a rotor with a thread, the threads of the rotors and the inside of the housing acting together, when the rotors are rotating, to transport a gas from the suction side to the pressure side, the rotor being segmented and including a suction-side segment and a pressure-side segment joined to the suction-side segment;

a hollow shaft supporting the rotor;

mutually spaced bearings on the shaft, all bearings being situated at the pressure side of the rotor;

each pressure-side segment being provided with a cavity adjacent the suction-side segment and open to the pressure side;

the bearing closest to the rotor being located on the pressure side outside the cavity;

a cooling agent, contacting an inner surface of the cavity directly;

a cooling pipe extending axially through a central opening of the hollow shaft, the inner surface of the cooling pipe forming a first channel in fluid connection with the cavity in the rotor, the central opening of the hollow shaft and the pipe forming a second channel surrounding the pipe, being annular and in fluid connection with the cavity in the rotor.

37. The pump according to claim 36, wherein the hollow shaft and the pressure-side segment are integral.

38. The pump according to claim 36, wherein the pressure-side segment has a smaller diameter than the suction-side segment.

39. The pump according to claim 36, wherein the suction-side segment and the pressure-side segment are threaded with different thread profiles, a depth of the thread profile of the pressure-side segment being smaller than a depth of the thread profile of the suction-side segment.

40. The pump according to claim 36, wherein the first channel supplies the cooling agent to the cavity and the second channel discharges the cooling agent from the cavity.

41. The pump according to claim 40, wherein a narrowed region is defined in a bearing-side end of the second channel.

42. The pump according to claim 41, wherein the cooling pipe is of a material having poor thermal conductivity.

43. The pump according to claim 36, wherein the cooling agent flowing through the pump is identical with a lubrication agent for the bearings.

44. The pump according to claim 36, wherein the cavity extends at least halfway through the rotor.

45. A cooled screw vacuum pump, having a suction side and a pressure side, comprising a housing and two rotating systems, each rotating system comprising:

a rotor with a thread, the threads of the rotors and the inside of the housing acting together, when the rotors are rotating, to transport a gas from the suction side to the pressure side;

a hollow shaft supporting the rotor;

mutually spaced bearings on the shaft, all bearings being situated at the pressure side of the rotor;

each rotor being provided with a cavity open to the pressure side;

the bearing disposed closest to the rotor being located outside the cavity;

a cooling pipe extending axially through the hollow shaft, an inner surface of the cooling pipe forming a first channel in fluid connection with the cavity for supplying a cooling agent to an inner surface of the cavity directly in the rotor;

and a central opening of the shaft and the pipe forming a second, annular channel surrounding the pipe, in fluid connection with the cavity in the rotor, and, a first set of channels through a wall of the housing adjacent the rotors through which the cooling agent flows.

46. The pump according to claim 45, further including:

in a region of the housing encasing the bearings, a second set of channels through which the cooling agent flows.

47. The pump according to claim 46, further including:

a cooling agent pump with an inlet in communication via a conductor system with a cooling agent sump located in the pump housing and with an outlet in communication with at least one of the cooling pipe disposed in the hollow shaft with a discharge end at the cavity, the first set of channels, and the second set of channels.

48. The pump according to claim 47, wherein the sump and the conductor system are designed in such fashion that the inlet of the cooling agent pump is in communication with the sump, both in horizontal and vertical positions of the pump.

49. The pump according to claim 45, wherein the first channel serves to supply the cooling agent to the cavity and the second channel serves to discharge the cooling agent from the cavity.

50. The pump according to claim 49, wherein a narrowed region is provided in the bearing-side end of the second channel.

51. The pump according to claim 50, wherein the cooling pipe is of a material having poor thermal conductivity.

52. The pump according to claim 45, wherein the cooling agent flowing through the pump is also a lubrication agent flowing over the bearings.

53. The pump according to claim 45, wherein the cavity extends at least halfway through the rotor.

* * * * *